United States Patent [19]

Geiszler, Jr.

[11] Patent Number: 4,700,725

[45] Date of Patent: Oct. 20, 1987

[54] ADJUSTABLE FILTER CIGARETTE

[75] Inventor: Willard A. Geiszler, Jr., Richmond, Va.

[73] Assignee: Philip Morris Incorporated, New York, N.Y.

[21] Appl. No.: 853,142

[22] Filed: Apr. 17, 1986

[51] Int. Cl.[4] ..... A24D 3/04

[52] U.S. Cl. ..... 131/336; 131/338; 131/198.2

[58] Field of Search ..... 131/336, 338, 361, 365, 131/198.1, 198.2, 178

[56] References Cited

U.S. PATENT DOCUMENTS

| | | | |
|---|---|---|---|
| 2,954,035 | 9/1960 | Saffir | 131/10 |
| 3,016,902 | 1/1962 | Lipp et al. | 131/10 |
| 3,327,718 | 6/1967 | Kilburn | 131/262 |
| 3,359,988 | 12/1967 | Thomson | 131/10.3 |
| 3,376,874 | 4/1968 | Kim et al. | 131/207 |
| 3,409,019 | 11/1968 | Chun | 131/10.7 |
| 3,428,050 | 2/1969 | Kandel | 131/10.3 |
| 3,490,461 | 1/1970 | Osmalov et al. | 131/10.5 |
| 3,503,406 | 3/1970 | Riegel et al. | 131/10 |
| 3,504,678 | 4/1970 | Pitt | 131/10.5 |
| 3,512,537 | 5/1970 | Pelletier | 131/9 |
| 3,608,561 | 9/1971 | Dock | 131/10 A |
| 3,738,375 | 6/1973 | Doumas | 131/10.3 |
| 3,789,855 | 2/1974 | Norman | 131/9 |
| 4,340,074 | 7/1982 | Tudor | 131/362 |
| 4,527,573 | 7/1985 | Hausermann | 131/336 |
| 4,532,943 | 8/1985 | Nichols et al. | 131/336 |

FOREIGN PATENT DOCUMENTS

| | | |
|---|---|---|
| 1058343 | 2/1967 | United Kingdom . |
| 2099678 | 12/1982 | United Kingdom . |

*Primary Examiner*—V. Millin
*Assistant Examiner*—H. Macey
*Attorney, Agent, or Firm*—Jeffrey H. Ingerman

[57] ABSTRACT

A variable dilution cigarette of the type having relatively rotatable filter segments for controlling dilution is provided with stops. Spaced-apart stop elements are provided on one filter segment and a tongue-like engagement element is provided on the other filter segment extending over the first segment between the stop elements. The edges of the engagement element engage the edges of the stop elements to limit rotation.

7 Claims, 6 Drawing Figures

ADJUSTABLE FILTER CIGARETTE

BACKGROUND OF THE INVENTION

This invention relates to filter cigarettes. More particularly, the present invention relates to filter cigarettes which are adjustable by the smoker to vary the air dilution value.

It is known to produce variable dilution cigarettes having integral rotatable elements for controlling dilution. The rotatable element can be a rotatable band of tipping paper retained by stationary bands against axial displacement and having a slit overlying a slit in the filter plug wrap with which it can be rotated into and out of registry. Alternatively, it can be a rotatable section of the filter plug, carrying with it a section of tipping paper extending over a stationary section of the filter plug. The extending section of the tipping paper has a slit which overlies a slit in the plug wrap on the stationary filter plug segment. The slits can be moved in and out of registry by rotating the rotatable filter segment. Such a cigarette is described in commonly-assigned U.S. Pat. No. 4,532,943, which is hereby incorporated by reference in its entirety.

In the manufacture of these types of cigarettes, the slits in the tipping paper and plug wrap are most easily formed by simultaneously slitting both layers with a knife or laser beam. The cigarettes are therefore assembled initially with the slits fully in registry both longitudinally and rotationally. The dilution level can then be adjusted by rotating the rotatable segment varying the rotational registry of the slits.

In such a cigarette, if the rotatable filter segment is rotated too far, it may break off. In addition, depending on the placement of the dilution slits, once the rotatable segment is rotated to an extreme of dilution, continued rotation of the rotatable filter segment in the same direction will begin to adjust the dilution level back toward the other extreme. These results of over-rotation might not be expected by a smoker, who may instead expect that continued rotation in a given direction would continue to adjust the dilution level in the same direction.

Such cigarettes, if manufactured by conventional cigarette making machinery, would always come from the pack set to the same dilution level. If a tactile indication of the rotational position of the rotatable segment were provided, a smoker who was familiar with the cigarette brand would be able to adjust the cigarette to a desired dilution level without looking—e.g., at night.

It would be desirable to be able to provide a variable dilution cigarette of the type described above which could not be rotated out of a preset rotational range and which provided a tactile indication of its rotational position.

SUMMARY OF THE INVENTION

It is an object of this invention to provide a variable dilution cigareete of the type described in which the rotatable element cannot be rotated beyond a preset rotational range.

It is also an object of this invention to provide a variable dilution cigarette of the type described which provides a tactile indication of the rotational position of the rotatable element.

In acccordance with this invention, a filter cigarette is provided which comprises a tobacco rod, a substantially cylindrical filter plug having a mouth end and a rod end both open to the passage of air and smoke, plug wrapping circumscribing the filter plug, and tipping paper circumscribing and joining the filter plug and a portion of the tobacco rod. At least one of the plug wrapping and tipping paper is substantially air-impermeable. The filter plug comprises a mouth-end segment axially connected to a rod-end segment for rotation about the axis of the cigarette, said segment having respective mouth and rod ends. The tipping paper has a first opening therein and the plug wrapping has a second opening therein underlying the first opening. The openings overlie one of the segments, such that rotation of the mouth-end segment relative to the rod-end segment varies the registry between the first and second openings for varying the air dilution value of the cigarette. Means are provided to restrict the relative rotation of the segments to a desired rotational range.

BRIEF DESCRIPTION OF THE DRAWINGS

The above and other objects and advantages of the invention will be apparent upon consideration of the following detailed description, taken in conjunction with the accompanying drawings, in which like reference characters refer to like parts throughout, and in which.

DETAILED DESCRIPTION OF THE INVENTION

Figure 1:
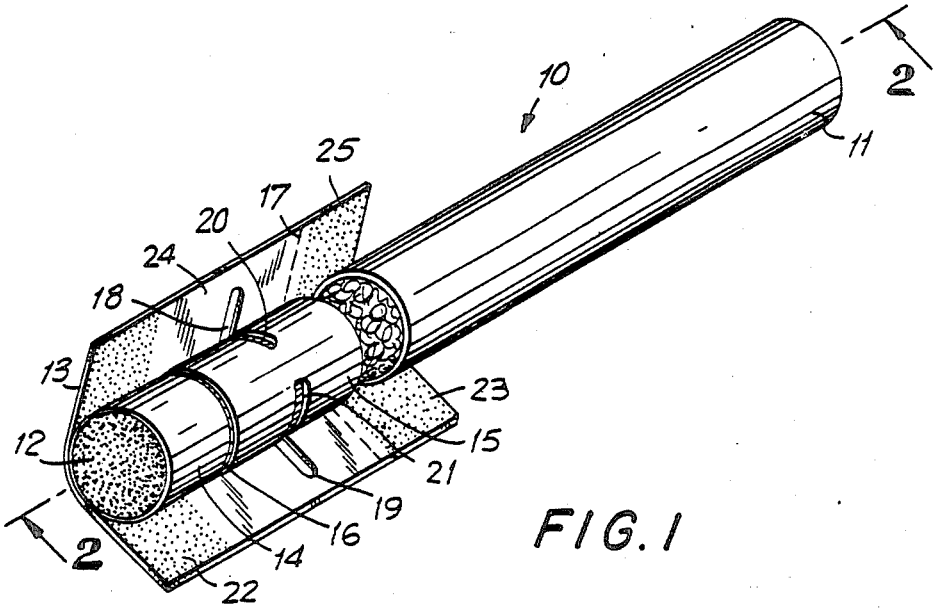
FIG. 1 is a partially exploded, perspective view taken from the mouth end of a variable dilution cigarette without rotation restricting means.
Figure 2:
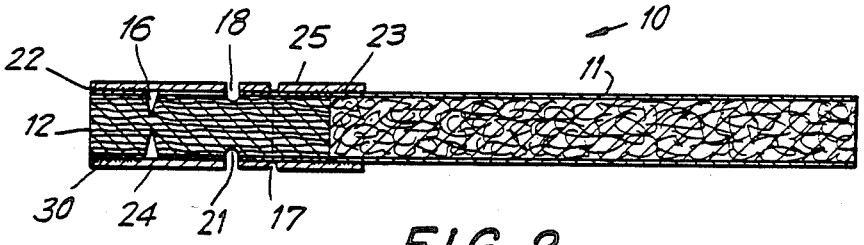
FIG. 2 is a cross-sectional view of the cigarette of FIG. 1, taken from line 2—2 of FIG. 1.
Figure 3:
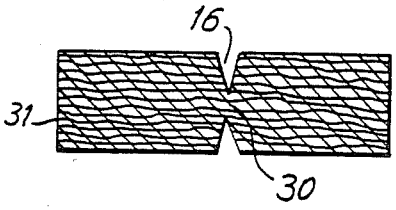
FIG. 3 is a cross-sectional view of the filter plug of the cigarette of FIGS. 1 and 2.

A cigarette of the type described in said above-incorporated commonly-assigned U.S. Pat. No. 4,532,943, is illustrated in FIGS. 1–3. The cigarette 10 comprises a tobacco rod 11—that is, a charge of smoking material wrapped in cigarette paper—attached to an axially aligned, wrapped cylindrical filter plug 12, and tipping paper 13. The filter plug 12 as a mouth end and a rod end, both of which are open to permit passage of air and smoke, and is divided into first and second segments 14, 15 by a circumferentially extending cut 16 which defines a central, axial core 30 about which the first segment 14 can be rotated relative to the second segment 15. The tipping paper 13 circumscribes and joins the filter plug 12 to the tobacco rod 11 in abutting end-to-end relation. Tipping paper 13 extends from substantially the mouth end of the filter plug 12, where it is fastened to segment 14 by adhesive band 22, to a point on the tobacco rod 11 adjacent the rod end of the filter plug 12, where it is fastened to both segment 15 and tobacco rod 11 by adhesive band 23. Tipping paper 13 also has a perforated break line 17 at a point between the circumferential cut 16 and the tobacco rod 11, dividing it into two tipping paper sections 24, 25.

Two openings 18, 19 are made through the tipping paper 13 corresponding to two openings 20, 21 in the underlying portion of the filter plug wrap. When perforation line 17 is broken, tipping paper section 24 is free to rotate with first segment 14 of the filter plug 12 about the axis of central core 30, such that openings 18, 19 in the tipping paper 13 and openings 20, 21 in the underlying portion of the plug wrap are in varying degrees of registry. Adjustment of the degree of registry permits varying amounts of air to enter the filter and combine with the smoke, thereby varying the air dilution value of the cigarette.

As described above, such cigarettes are assembled by providing a filter plug such as untipped filter plug 31, shown in FIG. 3, and attaching it to a tobacco rod 11 by overwrapping both untipped plug 31 and rod 11 with a length of tipping paper 13 which has already been provided with perforated break line 17. The tipping paper 13 is bonded by adhesive band 22 to the mouth end of filter plug 31 and by adhesive band 23 to the rod end of filter plug 31 and to the adjacent end of tobacco rod 11. A pair of slits is made through both tipping paper 13 and the wrapping of untipped filter plug 31 by a knife or laser beam, or other suitable means, simultaneously forming openings 18 and 20 and openings 19 and 21, transforming untipped filter plug 31 into filter plug 12.

As assembled, slits 18, 19 in tipping paper 13 are completely in registry with slits 20, 21 in the filter plug wrap and cigarette 10 is in its maximum dilution condition. As segment 14 is rotated relative to segment 15, slits 18, 19 and 20, 21 begin to deregister. After sufficient rotation, the slits are fully deregistered and cigarette 10 is in its minimum dilution condition. If segment 14 is rotated further in the same direction, slit 18 will begin to register with slit 21 and slit 19 will begin to register with slit 20, gradually returning cigarette 10 toward a condition of maximum dilution. In addition, the ability of core 16 to rotate is limited. After a small number of full revolutions, it will break, resulting in detachment of segment 14 from cigarette 10. Although indicia (not shown) may be printed on cigarette 10 to show a smoker the limits of the rotational range for minimum and maximum dilution, a smoker might not look at the indicia or might expect that if segment 14 were rotated beyond the indicated extremes, a more extreme dilution condition would be achieved.

Figure 4:
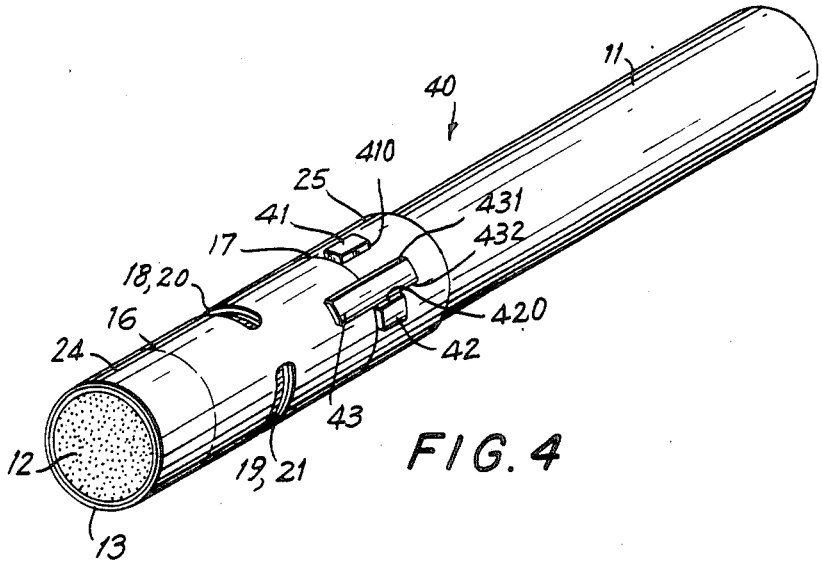
FIG. 4 is a perspective view taken from the mouth end of a variable dilution cigarette according to the invention.

A first embodiment 40 of a cigarette according to the present invention is shown in FIG. 4. Stop elements 41, 42 are affixed to tipping paper section 25, such as by adhesive. Engagement element 43 is a tongue affixed to section 24 and extending over, but not affixed to, segment 25 between stop elements 41, 42. When segment 14 is rotated, edges 431, 432 of engagement element 43 butt up against edges 410, 420 of stop elements 41, 42, preventing the rotation of segment 14 beyond a selected range determined by edges 410, 420.

Stop elements 41, 42 should be placed so that edges 410, 420 are separated by a distance equal to the desired rotational range plus the width of engagement element 43. More than one set of stop elements 41, 42 and engagement element 43 can be spaced around the circumference of the filter, with the number of sets limited only by the size of the elements and the spacing between them, as discussed below.

In a preferred embodiment, slits 18, 19, 20, 21 are each one quarter of the circumference of cigarette 40 in length. Therefore, for rotation between full registry and full deregistry, segment 14 must rotate 90° relative to segment 15. Therefore, the distance between each set of stop elements 41, 42 must be equal to one quarter of the cigarette circumference plus the width of engagement element 43. Two sets of elements 41, 42, 43 would thus occupy one-half of the cigarette circumference plus twice the sum of the widths of elements 41, 42, 43. As a practical matter, the maximum number of sets of elements 41, 42, 43 in a cigarette in which a 90° rotational range is desired is two. If three sets were used, elements 41, 42, 43 would have to be so narrow as to have little effectiveness. It is preferred that two sets of elements 41, 42, 43 be used rather than one, to provide a balanced stopping force, although a second set is not shown in FIG. 4 because it is on the far side of cigarette 40.

Elements 41, 42, 43 must be relatively stiff to have effect, otherwise element 43 would ride over elements 41, 42. Elements 41, 42, 43 are preferably made of a sheet material, most preferably cigarette tipping paper. The tipping paper should have a density of from about 30 $g/m^2$ to about 100 $g/m^2$, preferably from about 40 $g/m^2$ to about 60 $g/m^2$.

Elements 41, 42 could be the ends of a single band of sheet material wrapped around filter plug 12 outside tipping paper 13. The single band (not shown) could extend only partially around the circumference of the cigarette, its edges serving as edges 410, 420. Alternatively, the band could extend for a sufficient distance along the axial direction of cigarette 40 to allow it to have a first portion that extends completely around the circumference of the cigarette, and a second portion axially adjacent the first portion that extends only partially around the circumference of the cigarette, leaving a cutout adjacent tipping paper section 24, the edges of the cutout serving as edges 410, 420. Similarly, element 43 can project from a band that completely encircles cigarette 40. Other constructions may occur to one skilled in the art.

If desired, another layer of tipping paper (not shown) can cover elements 41, 42, 43. If such a layer is present, it may not be necessary for elements 41, 42, 43 to be made of anything heavier than standard tipping paper, having a density of from about 20 $g/m^2$ to about 40 $g/m^2$, as explained below in connection with the embodiment of FIG. 5.

Figure 5:
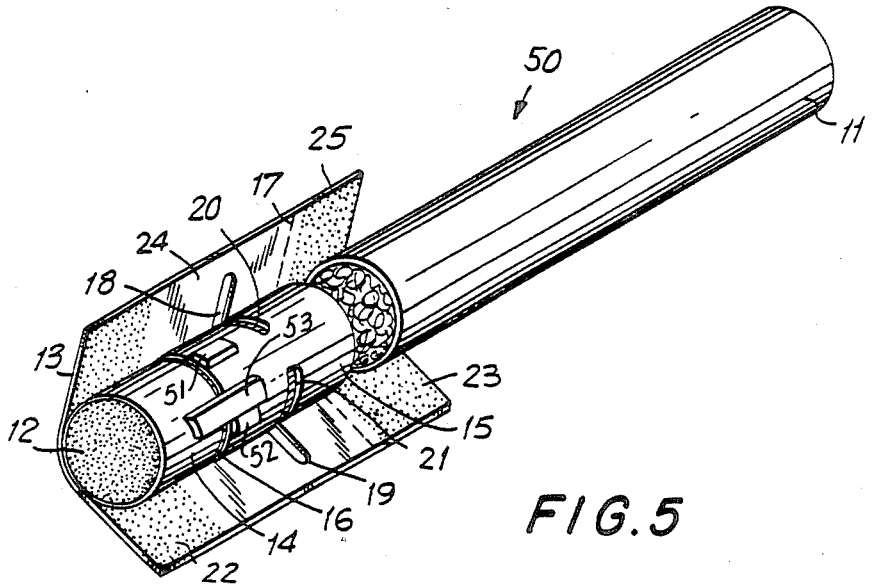
FIG. 5 is a partially exploded, perspective view taken from the mouth end of an alternative embodiment of a variable dilution cigarette according to the invention.

In the embodiment shown in FIG. 5, elements 51, 52, 53 are placed between tipping paper 13 and the filter plug wrap. The same criteria for spacing the elements applies as in FIG. 4, but because tipped cigarette filter assemblies are so tightly wrapped, elements 51, 52 will be sufficient to stop element 53 even if all three elements are made of standard tipping paper or plug wrapping material.

Figure 6:
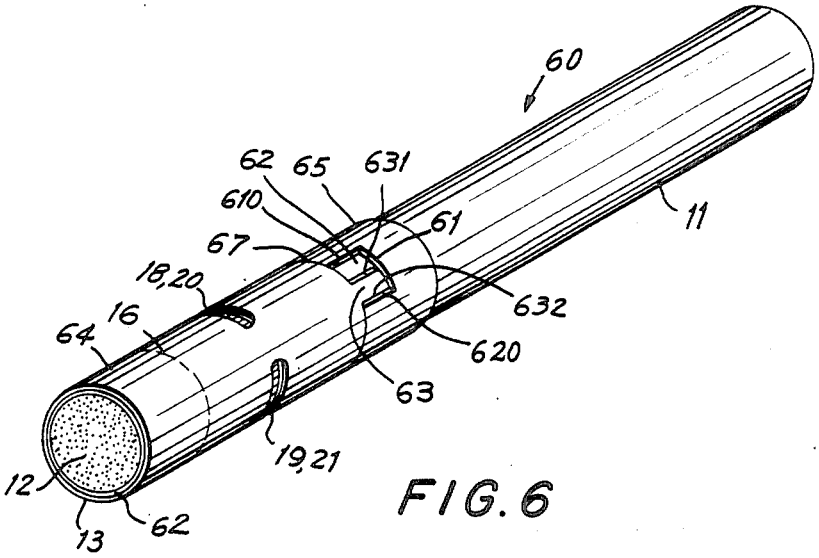
FIG. 6 is a perspective view taken from the mouth end of another alternative embodiment of a variable dilution cigarette according to the invention.

In the embodiment shown in FIG. 6, the stop surfaces and the engagement means are formed in the tipping paper 13. Instead of being cut in a straight line as at 17 to form tipping paper sections 24, 25 in FIGS. 1, 4 and 5, tipping paper 3 is cut at 67 to form section 64 having a tongue 63 and section 65 having a cutout 61 into which tongue 63 extends. Edges 631, 632 of tongue 63 engage edges 610, 620 of cutout 61 to limit the rotational motion of segment 14. In this embodiment, plug wrapping 62 must be substantially air-impermeable because it is exposed to cutout 61 and if it allowed air to pass it would lessen the control of dilution available through slits 18, 19, 20, 21. Similarly in this embodiment, tipping paper 13 should preferably be from about 30 $g/m^2$ to about 100 $g/m^2$ and most preferably from about 40 $g/m^2$ to about 60 $g/m^2$.

Although for ease of illustration in FIGS. 4–6 the tongue or engagement portion has been shown attached to segment 14 and the cutout or stop element portion has been shown attached to segment 15, the reverse is also within the scope of this invention. Similarly, the stop and engagement elements can be made from materials other than paper, such as plastic inserts or overlays.

A cigarette according to this invention provides positive control of the rotation of the filter segments to keep the diluton mechanism within its desired effective range. In addition, a smoker familiar with the cigarette can adjust the dilution level without looking by feeling for the extremes and then adjusting the rotatable segment to a known position between them.

Thus means are provided for limiting the rotation of the rotatable element of a variable dilution cigarette to a desired range and for providing a tactile indication of the rotational position of the rotational element. One skilled in the art will appreciate that the present invention can be practiced by other than the embodiments shown, which are presented for purposes of illustration and not of limitation, and the present invention is limited only by the claims which follow.

What is claimed is:

1. A filter cigarette comprising a tobacco rod, a substantially cylindrical filter plug having a mouth end and a rod end open to the passage of air and smoke, plug wrapping circumscribing said filter plug, and tipping paper circumscribing and joining said filter plug and a portion of said tobacco rod, at least one of said plug wrapping and said tipping paper being substantially air-impermeable, said filter plug comprising a mouth-end segment axially connected to a rod-end segment for rotation about the axis of the cigarette, each of said segments having respective mouth and rod ends, said tipping paper having a first opening therein and said plug wrapping having a second opening therein underlying said first opening, said openings overlying one of said mouth-end and rod-end segments, such that rotation of said mouth-end segment relative to said rod-end segment varies the registry between the first and second openings for varying the air dilution value of said filter cigarette, said filter cigarette further comprising positive stop means for restricting the relative rotation of said segments to a desired rotational range.

2. The filter cigarette of claim 1 wherein said positive stop means comprises a pair of spaced apart stop surfaces on one of said segments at the extremes of said desired rotational range and engagement means fixed to the other of said segments and extending over said one of said segments for engaging said stop surfaces when said segments are rotated to the extremes of said desired rotational range.

3. The filter cigarette of claim 2 wherein said stop surfaces are the edges of sections of sheet material and said engagement means is a tongue of sheet material.

4. The filter cigarette of claim 3 wherein said sheet material is paper.

5. The filter cigarette of claim 3 wherein said sheet material is fixed to the exterior surface of said cigarette.

6. The filter cigarette of claim 3 wherein said sheet material is fixed between said tipping paper and said plug wrapping.

7. The filter cigarette of claim 3 wherein:

said plug wrapping is substantially air-impermeable;

said tipping paper comprises a first section circumscribing and joining said rod-end segment and said portion of said tobacco rod, and a second section circumscribing and fixed to said mouth-end segment;

the section of said tipping paper overlying said one of said segments has a cutout section, the edges of said cutout section forming said stop surfaces; and a tongue is provided integrally with the segment of tipping paper fixed to said other one of said segments, said tongue extending into said cutout section.

* * * * *

UNITED STATES PATENT AND TRADEMARK OFFICE

CERTIFICATE OF CORRECTION

PATENT NO. : 4,700,725

DATED : October 20, 1987

INVENTOR(S) : Willard A. Geiszler, Jr.

It is certified that error appears in the above-identified patent and that said Letters Patent is hereby corrected as shown below:

Cover page, at [56] References Cited, FOREIGN PATENT DOCUMENTS, before "1058343 2/1967 United Kingdom ." should be inserted -- 1782545 9/1971 Fed. Rep. of Germany . --.

Column 1, line 58, "cigareete" should be -- cigarette --.

Column 2, line 52, "as" should be -- has --.

Column 4, line 57, "3" should be -- 13 --.

Column 5, line 10, "diluton" should be -- dilution --.

Signed and Sealed this

Twenty-ninth Day of March, 1988

*Attest:*

DONALD J. QUIGG

*Attesting Officer*

*Commissioner of Patents and Trademarks*